US005856057A

United States Patent [19]

Sinn et al.

[11] Patent Number: 5,856,057

[45] Date of Patent: Jan. 5, 1999

[54] CHROMOGENIC SOUND RECORDING FILM

[75] Inventors: Vicky Sinn; Richard C. Sehlin, both of Rochester; Mitchell J. Bogdanowicz, Spencerport; Patricia R. Greco, Rochester; Gary N. Barber, Penfield, all of N.Y.

[73] Assignee: Eastman Kodak Company, Rochester, N.Y.

[21] Appl. No.: 850,261

[22] Filed: May 5, 1997

Related U.S. Application Data

[60] Provisional application No. 60/034,040, Dec. 27, 1996.

[51] Int. Cl.[6] ..... G03C 5/14; G03C 1/825; G03C 5/28; G03C 7/24

[52] U.S. Cl. ..... 430/140; 430/364; 430/567; 430/572; 430/550; 430/510; 352/1; 352/26; 352/31

[58] Field of Search ..... 430/140, 364, 430/567, 572, 550, 510; 352/1, 26, 31

[56] References Cited

U.S. PATENT DOCUMENTS

| | | | |
|---|---|---|---|
| 1,756,863 | 4/1930 | Hoxie | 352/5 |
| 2,178,217 | 10/1939 | Baker | 352/5 |
| 2,430,588 | 11/1947 | Carroll et al. | 72/403 |
| 3,705,803 | 12/1972 | Bevis et al. | 430/140 |
| 3,715,208 | 2/1973 | Lestina et al. | 430/140 |
| 3,945,824 | 3/1976 | Sakai et al. | 430/140 |
| 4,178,183 | 12/1979 | Ciurca, Jr. et al. | 430/140 |
| 4,208,210 | 6/1980 | Sakai et al. | 430/140 |
| 4,216,284 | 8/1980 | Sakai et al. | 430/140 |
| 4,233,389 | 11/1980 | Fernandez et al. | 430/140 |
| 4,250,251 | 2/1981 | Osborn et al. | 430/140 |
| 4,430,422 | 2/1984 | Van de Sande et al. | 430/140 |
| 4,461,552 | 7/1984 | Levine | 352/27 |
| 4,553,833 | 11/1985 | Kanaoka et al. | 355/40 |
| 4,600,280 | 7/1986 | Clark | 352/37 |
| 4,839,267 | 6/1989 | Monbaliu et al. | 430/140 |
| 5,362,616 | 11/1994 | Edwards et al. | 430/356 |
| 5,491,053 | 2/1996 | Barber et al. | 430/549 |
| 5,587,749 | 12/1996 | Goldberg et al. | 352/27 |

FOREIGN PATENT DOCUMENTS

| | | | |
|---|---|---|---|
| 574136 | 12/1993 | European Pat. Off. | G11B 1/00 |
| 574239 | 12/1993 | European Pat. Off. | G11B 7/00 |
| 605141 | 7/1994 | European Pat. Off. | G03C 5/14 |
| 230638 | 8/1978 | U.S.S.R. . | |
| 430747 | 8/1978 | U.S.S.R. | G03C 1/12 |
| 93/22710 | 11/1993 | WIPO | G03B 31/02 |

OTHER PUBLICATIONS

Eastman Digital Sound Recording Film 2374™, Preliminary Data Sheets, 1990.

*Primary Examiner*—Mark F. Huff
*Attorney, Agent, or Firm*—Andrwe J. Anderson

[57] ABSTRACT

A motion picture sound recording chromogenic photographic film element for forming non-neutral images is disclosed comprising a film support bearing at least one silver halide emulsion layer comprising at least one dye-forming coupler which forms a dye which absorbs primarily in the green or red light region of the electromagnetic spectrum upon processing with color negative developer, wherein the element does not comprise a neutral-balanced combination of cyan, magenta, and yellow dye-forming couplers. A method for forming a soundtrack image in a motion picture print film is also disclosed, comprising recording a soundtrack negative in a chromogenic soundtrack recording film as described above by exposing said film and processing said exposed film with a color developer process to form a dye soundtrack negative, and printing a soundtrack onto a negative-working motion picture print film by exposing the motion picture print film through the dye soundtrack negative and processing the exposed print film to form a positive soundtrack. In accordance with preferred embodiments of the invention, the light-sensitive emulsion layer of the sound recording film comprises green or red light-sensitive silver halide emulsion grains and a cyan or magenta dye-forming coupler in the substantial absence of yellow dye-forming coupler. In accordance with most preferred embodiments, the light-sensitive emulsion layer of the sound recording film comprises green and red light-sensitive silver halide emulsion grains and cyan and magenta dye-forming couplers in the substantial absence of yellow dye-forming coupler.

20 Claims, No Drawings

CHROMOGENIC SOUND RECORDING FILM

CROSS REFERENCE TO RELATED APPLICATION

Reference is made to and priority claimed from U.S. Provisional application U.S. Ser. No. 60/034,040, filed 27 Dec. 1996, entitled Chromogenic Sound Recording Film.

TECHNICAL FIELD

This invention relates generally to the field of motion picture films, and in particular to a sound recording film and use thereof in printing sound tracks on a motion picture print film.

BACKGROUND OF THE INVENTION

Motion picture print films, the film that is shown in movie theaters, commonly employ optical soundtracks along at least one edge of the film. The most common optical soundtracks presently in use are analog soundtracks of the "variable area" type wherein signals are recorded in the form of a varying ratio of opaque to relatively clear area along the soundtrack. During projection of the motion picture images, a light source illuminates the soundtrack and a photosensor senses the light passing through and modulated by the soundtrack to produce an audio signal that is sent to amplifiers of the theater sound system. Digital soundtracks for motion picture films have been more recently introduced, wherein sound information is recorded in a digital format, e.g. comprising small data bit patterns on the film, typically between perforations of the motion picture film (e.g., Dolby™ Digital Stereo soundtracks) or along the film edge (e.g., Sony™ Dynamic Digital Sound soundtracks). U.S. Pat. Nos. 4,600,280 and 4,461,552, e.g., disclose methods in which digital audio is photographically recorded on motion picture film.

In order to optimize the visual quality of the motion picture image as well as the sound quality of the soundtrack recorded on a motion picture print film, the motion picture and soundtrack are first typically captured or recorded on separate photosensitive films as negative images, and the resulting negatives are then printed in synchronization on a motion picture print film to form positive images. On account of the very short exposure times which must be given to each separate picture, or frame, in capturing a motion picture image, a camera negative film employing relatively fast silver halide emulsions is typically used to record the motion picture images (e.g., Eastman Color Negative Films). In order to reproduce the wide ranges of colors and tones which may be found in various images, the camera film typically also has a relatively low contrast or gamma. Variable area analog soundtracks and digital soundtracks, however, are best recorded with high contrast, relatively slower speed films (e.g., Eastman Sound Recording Films) in order to generate desired sharp images for the sound recording and minimize background noise generated by relatively high minimum densities typically associated with relatively fast camera negative films.

Sound recording films have typically comprised silver-based black-and-white films free from any dye-forming coupler compounds, designed to be processed with conventional black-and-white developer solutions to form silver-based black-and-white images, such as the D-97 process as specified in Module 15 of the Kodak Publication H-24 titled "Manual for Processing Eastman Motion Picture Film", the disclosure of which is incorporated herein by reference. In such processes, after exposure, black-and-white images are generally produced by developing silver halide in a black-and-white developer, such as hydroquinone, to form a silver image by reducing the exposed silver halide to silver metal. The undeveloped silver halide is removed from the film by "fixing" with aqueous sodium thiosulfate. The silver metal remaining in the print represents the image.

Most motion picture scenes today are filmed using color negative film designed to be processed in a color developer process wherein dye images are formed and essentially all silver is removed, such as the process ECN-2, described in Module 7 of the Kodak Publication H-24 incorporated by reference above. Motion picture film processing laboratories which wish to process both black-and-white sound recording film and color negative films must have separate processing systems; one for color and one for black-and-white, as the two systems are not compatible. Various photographic products have been previously proposed for forming black-and-white images through use of color processing, such as U.S. Pat. Nos. 5,362,616 and 5,491,053 directed towards chromogenic black-and-white photographic elements for forming neutral images. While U.S. Pat. No. 5,491,053 is directed towards chromogenic black-and-white motion picture print films, and U.S. Pat. No. 5,362,616 suggests the technology disclosed therein may be advantageously used to produce a motion picture sound track film, the photographic materials described in these patents require specific emulsion layer formats and cyan, magenta, and yellow dye-forming coupler combinations in order to form neutral images, and such films do not necessarily meet desired performance criteria for sound recording films. It would, therefore, be advantageous to provide an effective sound recording film which could be utilized with a conventional color processing system. It would be further advantageous to be able to provide such a film at low costs and high quality.

SUMMARY OF THE INVENTION

In accordance with one embodiment of the invention, a motion picture sound recording chromogenic photographic film element for forming non-neutral images is disclosed comprising a film support bearing at least one silver halide emulsion layer comprising at least one dye-forming coupler which forms a dye which absorbs primarily in the green or red light region of the electromagnetic spectrum upon processing with color negative developer, wherein the element does not comprise a neutral-balanced combination of cyan, magenta, and yellow dye-forming couplers.

In accordance with a second embodiment of the invention, a method for forming a soundtrack image in a motion picture print film is disclosed, comprising recording a soundtrack negative in a chromogenic soundtrack recording film as described above by exposing said film and processing said exposed film with a color developer process to form a dye soundtrack negative, and printing a soundtrack onto a negative-working motion picture print film by exposing the motion picture print film through the dye soundtrack negative and processing the exposed print film to form a positive soundtrack.

In accordance with preferred embodiments of the invention, the light-sensitive emulsion layer of the sound recording film comprises green or red light-sensitive silver halide emulsion grains and a cyan or magenta dye-forming coupler in the substantial absence of yellow dye-forming coupler. In accordance with most preferred embodiments, the light-sensitive emulsion layer of the sound recording film comprises green and red light-sensitive silver halide emulsion grains and cyan and magenta dye-forming couplers in the substantial absence of yellow dye-forming coupler.

ADVANTAGEOUS EFFECT OF THE INVENTION

The invention has numerous advantages over the prior processes. The invention of a motion picture sound recording film utilizing color couplers to form a sound track image allows use of existing motion picture color film processing systems. Therefore, a parallel black-and-white processing system for silver halide black-and-white development is not needed. Further, as the silver does not form the image, there is a cost savings in materials utilized in forming the sound recording film, as well as in the processing of it. Further, the system of the invention allows the formation of images formed from color couplers in layers that do not need to be balanced to form neutral images. The substantial absence of yellow dye-forming couplers in accordance with preferred embodiments of the invention provides a manufacturing cost advantage.

DETAILED DESCRIPTION

Chromogenic sound recording films comprising light-sensitive silver halide emulsions and dye-forming couplers in accordance with the invention can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. Preferred color developing agents are p-phenylenediamines such as: 4-amino-N,N-diethylaniline hydrochloride; 4-amino-3-methyl-N,N-diethylaniline hydrochloride; 4-amino-3-methyl-N-ethyl-N-(b-(methanesulfonamido)ethyl)aniline sesquisulfate hydrate; 4-amino-3-methyl-N-ethyl-N-(b-hydroxyethyl)aniline sulfate; 4-amino-3-b-(methanesulfonamido)ethyl-N,N-diethylaniline hydrochloride and 4-amino-N-ethyl-N-(2-methoxyethyl)-m-toluidine di-p-toluene sulfonic acid. Development is usually followed by the conventional steps of bleaching, fixing, or bleach-fixing, to remove silver or silver halide, washing, and drying.

In the following discussion of suitable materials for use in the sound recording films and sound recording methods of this invention, reference will be made to *Research Disclosure*, September 1996, Item No. 38957, published by Kenneth Mason Publications, Ltd., Dudley Annex, 12a North Street, Emsworth, Hampshire PO10 7DQ, ENGLAND, the disclosure of which are incorporated herein by reference. This publication will be identified hereafter by the term "Research Disclosure." A reference to a particular section in "Research Disclosure" corresponds to the appropriate section in the above-identified *Research Disclosure*. The elements of the invention can comprise emulsions and addenda described therein, as well as in the further publications referenced therein.

Conventional silver-based black-and-white films which form color neutral images have been traditionally used for recording sound tracks. To make a color neutral black-and-white image using a mixture of dyes formed from couplers, it is necessary to balance the ratio of couplers in the imaging layers of a photographic element so that after exposure and color development the resultant image is neutral and lacks any specific color bias. When a sound negative recording film having a developed negative soundtrack is exposed onto a motion picture print film to form a positive soundtrack, a tungsten light with a yellow filter is customarily used in order to expose the green and red light-sensitive layers of the print film, while avoiding exposure in the blue light-sensitive layer of the print film. The green and red light-sensitive layers are exposed to provide sufficient density for the sound track, while exposure of the blue light-sensitive layer is avoided as exposure of the print film blue layer typically results in a grainy image which in turn leads to poorer sound quality upon reading of the print film soundtrack. Since blue light is typically not used when exposing the sound negative film onto the print film, there is no need to have any yellow dye present in the sound negative film, or to otherwise balance a combination of cyan, magenta, and yellow dyes in order to provide a neutral balanced chromogenic sound recording film. Accordingly, only magenta or cyan dye-forming couplers (i.e., couplers which form dyes which absorb primarily in the green and/or red light regions of the electromagnetic spectrum upon processing with a p-phenylenediamine color negative developing agent, such as standard ECN-2 color processing), or combinations thereof, are needed in a chromogenic sound recording film in accordance with the invention to form magenta or cyan dyes in order to modulate green and/or red light during exposure of the sound track in the print film.

The motion picture sound recording films of the invention comprise a film support bearing at least one silver halide emulsion layer comprising at least one dye-forming coupler which forms a dye which absorbs primarily in the green or red light region of the electromagnetic spectrum upon processing with color negative developer, wherein the element does not comprise a neutral-balanced combination of cyan, magenta, and yellow dye-forming couplers. Preferably, the sound recording film comprises at least one of magenta dye-forming couplers or cyan dye-forming couplers, more preferably both such couplers, or a single coupler which forms a dye which absorbs in both the green and red light regions of the electromagnetic spectrum, or a combination of such couplers. In further preferred embodiments of the invention, the sound recording film is substantially free of yellow dye-forming couplers. For the purposes of this invention, the terms blue, green, and red light refer to the approx. 380–500 nm, approx. 500–600 nm, and approx. 600–760 nm regions, respectively, of the electromagnetic spectrum, and the term "substantially free of yellow dye-forming coupler" is used to describe the substantial absence of couplers which form primarily yellow image dyes (i.e., image dyes which absorb primarily in the blue light region of the electromagnetic spectrum) upon processing with a p-phenylenediamine color negative developing agent, such as standard ECN-2 color processing. While multiple light-sensitive layers may be used comprising separate sensitized silver halide emulsions, chromogenic sound recording films of the invention preferably comprise a single silver halide emulsion layer, which comprises dye forming couplers and a silver halide emulsion or emulsions preferably sensitized as described above.

Couplers that may be used in the elements of the invention can be defined as being 4-equivalent or 2-equivalent depending on the the number of atoms of $Ag^+$ required to form one molecule of dye. A 4-equivalent coupler can generally be converted into a 2-equivalent coupler by replacing a hydrogen at the coupling site with a different coupling-off group. So-called "1-equivalent" couplers may also be used, wherein the coupling-off group itself forms a second image dye. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published application Nos. 1,466,728; 1,531,927; 1,533,039; 2,006,755A and 2,017,704A, the disclosures of which are incorporated herein by reference.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler - Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Typical pyrazoloazole and pyrazolone couplers are represented by the following formulas:

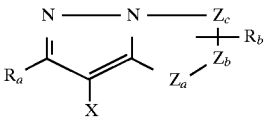

MAGENTA-1

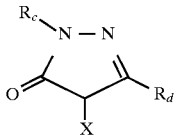

MAGENTA-2 wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =CH—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$. Preferably, a ballast group is incorporated in either $R_a$ or $R_b$ in MAGENTA-1 and in either $R_c$ or $R_d$ in MAGENTA-2.

Couplers that form cyan dyes upon reaction with oxidized color developing agents which may be included in elements of the invention include those which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler - Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

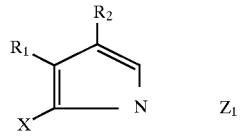

CYAN-1

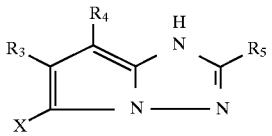

CYAN-2

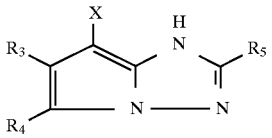

CYAN-3

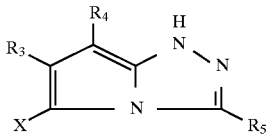

CYAN-4

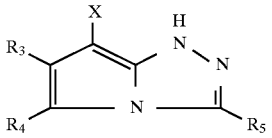

CYAN-5

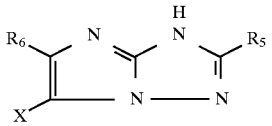

CYAN-6 wherein $R_1$ and $R_5$ each represent a hydrogen or a substituent; $R_2$ represents a substituent; $R_3$ and $R_4$ each represent an electron attractive group having a Hammett's substituent constant $\delta_{para}$ of 0.2 or more and the sum of the $\delta_{para}$ values of $R_3$ and $R_4$ is 0.65 or more; $R_6$ represents an electron attractive group having a Hammett's substituent constant $\delta_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —NH—, CH(R)—, etc., that preferably has a pKa value of from 3 to 12 in water. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

More preferable are cyan couplers of the following formulas:

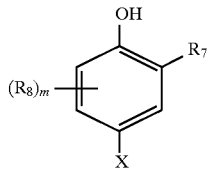

CYAN-7

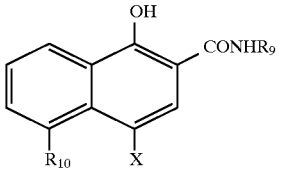

CYAN-8 wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

To control the migration of various components coated in a photographic layer, including couplers, it is preferable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents. Typical examples of photographic substituents include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclythio, spiro compound residues and bridged hydrocarbon compound residues. Usually the substituent will have less than 30 carbon atoms and typically less than 20 carbon atoms.

Dye forming couplers may be incorporated into elements in accordance with the invention in accordance with known techniques. Typically, photographic dye-forming couplers, as well as other hydrophobic photographically useful compounds, are generally incorporated into a layer of a photographic element by first forming an aqueous dispersion of the couplers and then mixing such dispersion with the layer coating solution. An organic solvent is generally used to dissolve the coupler, and the resulting organic solution is then dispersed in an aqueous medium to form the aqueous dispersion. The organic phase frequently includes high-boiling or permanent organic solvents, optionally with low-boiling or water-miscible auxiliary solvents. Permanent high boiling solvents have a boiling point sufficiently high, generally above 150° C. at atmospheric pressure, such that they are not evaporated under normal dispersion making and photographic layer coating procedures, while auxiliary solvents are either evaporated or washed out after the coupler is dispersed. Permanent high-boiling coupler solvents are thus incorporated into the emulsion layer coating solution and ultimately into the photographic element. Where multiple couplers are incorporated into film elements in accordance with the invention, they may be added as separate dispersions, or may be codispersed in a single dispersion.

The silver halide emulsion layer of the sound recording film of the invention may include any type of silver halide grains. Such grains can be comprised of, e.g., silver bromide, silver chloride, silver iodide, silver bromochloride, silver bromoiodide, silver iodochloride, silver iodobromide, silver chlorobromoiodide or mixtures thereof; and can be of various shapes and size.

Silver and coupler laydowns in the emulsion layer or layers of the chromogenic sound recording films of the invention are preferably sufficient to provide maximum Status M Green or Red densities of at least 3.4 (more preferably at least 4.0, and most preferably at least 4.5) after exposure and standard processing in the ECN-2 process as specified in Module 7 of the Kodak Publication H-24 titled "Manual for Processing Eastman Motion Picture Film", the disclosure of which is incorporated by reference. In order to also provide a high contrast film (e.g., contrast overall gradients preferably greater than 3.3, more preferably greater than 3.5, and most preferably greater than 3.8, wherein the overall gradient is defined as the slope of the straight line portion of a Status M Red or Green D logE characteristic curve between 0.3 and 2.3 above minimum density) desirable for recording a soundtrack with sharp edges, the emulsion layer of the sound recording film of the invention preferably comprises a fine grain (e.g., average grain size less than 0.25 micron, more preferably less than 0.2 micron and most preferably less than 0.15 micron) monodispersed silver halide emulsion (e.g., cubical silver halide grains having a coefficient of variation ("C.O.V.") of grain diameter of less than 55%, preferably less than 45% and most preferably less than 35%, wherein C.O.V. is defined as the standard deviation (sigma) of grain diameter for the emulsion divided by the mean grain diameter, times 100). The emulsion grain size is particularly important for the chromogenic sound recording films of the invention, as the formation of dye images around developed silver halide grains during color photographic processing results in relatively larger image pixels compared to an image comprising black-and-white developed silver grains. Thus, while silver halide grains of average sizes greater than 0.25 micron have been traditionally used for black-and-white sound recording films, such larger emulsions result in undesirably grainy images if used in combination with color couplers and color processing in forming a sound track image.

To provide the above preferred densities and contrasts, various silver halide emulsion and coupler levels may be used depending upon the emulsion speed and efficiency as well as the coupler activity. The selection and optimization of such levels to provide the preferred densities and contrasts specified above may be readily determined by one skilled in the art. Preferred silver halide emulsion laydowns range from about 500–2500 mg/m$^2$, more preferably about 800–1800 mg/m$^2$, and preferred cyan and magenta coupler laydowns each range from about 500–3000 mg/m$^2$, more preferably about 700–2000 mg/m$^2$.

White light sources such as tungsten lamps have conventionally been used to record analog soundtracks. As the spectral power distribution of tungsten light is highest in the red region of the visible electromagnetic spectrum, the silver halide of the light sensitive emulsion layer of the sound recording films of the invention are preferably sensitized to red light. Alternatively or additionally, green and/or blue light-sensitive emulsions may be used to provide additional white-light sensitivity. Digital soundtrack recording is typically performed by exposing a sound recording film to a modulated coherent radiation light source having a narrow band width, such as a modulated laser beam or light emitting diode or diode array, typically in the green or red light region. Sound recording films in accordance with the invention may accordingly be optimally green and/or red spectrally sensitized to provide a peak sensitivity to match a particular digital recording device, along with providing adequate sensitivity for recording analog soundtracks with white light sources.

Process-removable filter or absorber dyes are preferably used in the light-sensitive layer of sound recording films in accordance with the invention to assist in emulsion layer speed-control and to provide improved image sharpness, which is particularly important for forming analog sound tracks. Any conventional photographic absorber dye may be used which absorbs in the sensitivity range of the silver halide emulsion and exposing light source. Useful absorber dyes are described, e.g., in Research Disclosure cited above, Section VIII, and references cited therein. Where red and green sensitized emulsions are used, red and green absorber dyes are each preferably used at levels of from about 5–200 mg/M$^2$, more preferably 10–160 mg/m$^2$, to provide effective emulsion speed and image sharpness control.

According to common analog soundtrack recording procedures, sound recording films are exposed to tungsten light in a sound recorder to capture the latent image of an analog sound pattern. The typical equivalent shutter speeds of commercial analog soundtrack recorders are on the order of $10^{-3}$ second exposure time. Typical digital recording exposure times using lasers or light emitting diodes range from $10^{-3}$ second to $10^{-4}$ second or less. In order to enable efficient capture of both analog soundtracks recorded with tungsten light as well as digital soundtracks, in a preferred embodiment of the invention emulsions having a reciprocity speed differential of less than 0.25 logE, more preferably less than 0.2 logE, and most preferably less than 0.1 logE over a range of exposure times from $10^{-3}$ to $10^{-4}$ second, wherein the reciprocity speed differential is measured at a density of 2.5. Reciprocity performance may be achieved using known techniques such as through use of dopants and/or chemical sensitization. Dopants, such as compounds of copper, thallium, lead, bismuth, cadmium and Group VIII noble metals, can be present during preparation of silver halide grains employed in emulsion layers of the sound recording film. Possible dopants also include transition metal complexes as described in U.S. Pat. Nos. 4,981,781, 4,937,180, and 4,933,272.

Emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions are preferably negative-working emulsions such as surface-sensitive emulsions or unfogged internal latent image-forming emulsions. The silver halide grains of the emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in Research Disclosure cited above, Section IV.

Silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in U.S. Pat. No. 2,430,558 and other references cited in Research Disclosure cited above. The sound recording film emulsions may be effectively spectrally sensitized both below and above 600 nm. This may be accomplished with a sensitizing dye providing a broad sensitivity peak for the sensitized emulsion which spans substantial portions of both the green (e.g., 500–600 nm) and red (e.g., 600–760) regions of the spectrum, or through use of multiple sensitizing dyes providing peak sensitivities both above and below 600 nm. In a preferred embodiment, the sound recording film emulsions are spectrally sensitized with a first green spectral sensitizing dye providing a peak sensitivity at less than or equal to 600 nm and a second red spectral sensitizing dye providing a peak sensitivity above 600 nm. Such first and second dyes may be used together to spectrally sensitize a single silver halide emulsion, or may alternatively be used to sensitize separate emulsions, which may then be combined and coated in a single layer or coated in separate layers. In a preferred embodiment, the sound recording film emulsions may be spectrally sensitized with green and red spectral sensitizing dyes providing substantial sensitivities at about 580 nm and at about 670 nm. In further embodiments, the sound recording film may also be sensitized to the infrared and/or ultraviolet regions of the electromagnetic spectrum.

The sound recording film of the invention is preferably spectrally sensitized so as to require less than 0.23 erg/cm$^2$, more preferably less than 0.21 erg/cm$^2$, and most preferably less than 0.2 erg/cm$^2$ of energy at wavelengths of 580 nm and 670 nm, and more preferably for all wavelengths throughout the green and red regions of the electromagnetic spectrum, to produce Status M Green and Red densities of 0.40 after exposure and standard processing in the ECN-2 process as specified in Module 7 of the Kodak Publication H-24 titled "Manual for Processing Eastman Motion Picture Film", the disclosure of which is incorporated by reference. In order to be able to produce desirably high maximum densities with conventional exposure and processing, the sound recording film of the invention also is preferably spectrally sensitized so as to require less than 1.9 erg/cm$^2$, more preferably less than 1.7 erg/cm$^2$, and most preferably less than 1.6 erg/cm$^2$ of energy at wavelengths of 580 nm and 670 nm, and more preferably for all wavelengths throughout the green and red regions of the electromagnetic spectrum, to produce Status M Red and Green densities of 3.75 after exposure and standard processing in the ECN-2 process.

Sound recording films in accordance with the invention may be sensitized at any specific desired wavelengths, or may be pansensitized across the visible spectrum, so as to be able to be used with any wavelength exposing source within such range. Blue sensitizing dyes may be used along with green and red dyes to provide pansensitization, or an innately blue sensitive emulsion may be used along with a green and red sensitizing dye or dyes, or combinations of individually spectrally sensitized emulsions and innately sensitized emulsions may be used. A sound recording film is considered to be substantially panchromatically sensitive across a wavelength range when it satisfies the above energy requirements to produce Status M Red or Green densities of 0.4 for all wavelengths within the range. Panchromatically sensitive films also preferably satisfy the above energy requirements to produce Status M Red or Green densities of 3.75 for all wavelengths within the range.

Suitable vehicles for the emulsion layer and other layers of elements of this invention include hydrophilic colloids such as described in Research Disclosure, Section II and the publications cited therein. In preferred embodiments of the invention, the hydrophilic colloid is gelatin. This may be any gelatin or modified gelatin such as acetylated gelatin, phthalated gelatin, oxidized gelatin, etc. Gelatin may be base-processed, such as lime-processed gelatin, or may be acid-processed, such as acid processed ossein gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The photographic elements can contain further compounds typically incorporated in chromogenic photographic elements as described in Research Disclosure cited above, including brighteners, antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), anti stain agents and image dye stabilizers, light absorbing and scattering materials, hardeners, polyalkyleneoxide and other surfactants as described in U.S. Pat. No. 5,236,817, coating aids, plasticizers and lubricants, antistatic agents, matting agents and development modifiers, etc.

In addition to the silver halide emulsion layer, the sound recording film used in accordance with the invention may include further features and layers as are generally known in the photographic art. For example, an antistatic layer may be included on either side of the support, along with additional conventional interlayers and overcoat layers. Preferred supports for the films comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate).

In a preferred embodiment of the invention, an antistatic layer is coated on the backside of the film support opposite to the silver halide emulsion layer. Any antistatic materials such as those previously suggested for use with photographic elements may be used. Such materials include, e.g., ionic polymers, electronic conducting non-ionic polymers, and metal halides or metal oxides in polymer binders.

Conductive fine particles of crystalline metal oxides dispersed with a polymeric binder have been used to prepare optically transparent, humidity insensitive, antistatic layers for various imaging applications. Many different metal oxides, such as AnO, $TiO_2$, $ZrO_2$, $Al_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,275,103; 4,394,441; 4,416,963; 4,418,141; 4,431,764; 4,495,276; 4,571,361; 4,999,276; and 5,122,445, the disclosures of which are hereby incorporated by reference. Preferred metal oxides are antimony doped tin oxide, aluminum doped zinc oxide, and niobium doped titanium oxide, as these oxides have been found to provide acceptable performance characteristics in demanding environments. Particular preferred metal oxides for use in this invention are antimony-doped tin oxide and vanadium pentoxide which provide good resistance to static discharge.

An overcoat layer is preferably provided over the silver halide emulsion layer(s) of the sound recording film of the invention. Such overcoat may include lubricants and matting agents to minimize scratch susceptibility of the sound negative to scratches and handling damage that may impact the digital decoding processes described in the art which require digital error correction or switching to analog tracks for continuous sound playback. A diverse variety of lubricants can be used to provide appropriate lubricity. Preferred lubricates include those synthesized via the transesterification of methyl myristrate, methyl palmitate, methyl stearate, diethylene glycol and/or triethylene glycol, and commercially available silicon based lubricants such as Dow Corning 200, preferably as a mixture with Tergitol 15-S-5 or Synthetic Spermafol. The preferred range of active ingredient for best preventing handling scratches that may impact the decoding of digital audio sound tracks is from about 0.2 to 1 $mg/m^2$ in the overcoat layer. Such active ingredients are preferably coated in a hydrophilic colloid layer, such as a gelatin overcoat layer. The silver halide and overcoat layers are preferably hardened with conventional gelatin hardeners.

If desired, the recording films can be used in conjunction with an applied magnetic layer as described in U.S. Pat. Nos. 4,279,945 and 4,302,523 and *Research Disclosure*, November 1992, Item 34390 published by Kenneth Mason Publications, Ltd., Dudley House, 12 North Street, Emsworth, Hampshire P010 7DQ, ENGLAND.

In accordance with the invention, multiple analog and/or digital soundtracks may be recorded using a white light (e.g., tungsten) exposing source or substantially monochromatic exposing devices such as lasers or light emitting diodes operating at wavelengths above or below 600 nm. Such exposures may be performed in accordance with conventional digital and analog recording equipment. The various exposing devices may be arranged so that the sound recording film may be transported in a single loop in sequence through the recorders, and selectively exposed on different portions of the film through use of filters, masks, etc. The exposed sound negative may then be processed in a color developer process, such as the ECN-2 process as described in Kodak Publication H-24 referenced above. The sound negative may then be printed along with a motion picture visual negative on a motion picture print film, such as Eastman Color Print Film 5386.

In motion picture color printing, there are usually three records to record simultaneously in the image area frame region of a print film, i.e., red, green and blue. The original image record to be reproduced is preferably an image composed of sub-records having radiation patterns in different regions of the spectrum. Typically it will be a multicolor record composed of sub-records formed from cyan, magenta and yellow dyes. The principle by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research*

*Disclosure* referenced above. Materials in which such images are formed can be exposed to an original scene in a camera, or can be duplicates formed from such camera origination materials, such as records formed in color negative intermediate films such as those identified by the tradenames Eastman Color Intermediate Films 2244, 5244 and 7244. The peak absorptions for such films are typically in the blue region of the spectrum at about 440 nm, in the green region of the spectrum at about 540 nm, and in the red region of the spectrum at about 680 nm.

Motion picture color print films typically comprise a support bearing light sensitive yellow, magenta, and cyan dye forming layers sensitized respectively to the blue (approx. 380–500 nm), green (approx. 500–600 nm), and red (approx. 600–760 nm) regions of the electromagnetic spectrum. Such materials are described in the Research Disclosure publications cited above. Such light sensitive materials may also be sensitive to one or more regions of the electromagnetic spectrum outside the visible, such as the infra red region of the spectrum. In most color photographic systems, color-forming couplers are incorporated in the light-sensitive photographic emulsion layers so that during development, it is available in the emulsion layer to react with the color developing agent that is oxidized by silver image development. Diffusible couplers are used in color developer solutions. Non-diffusing couplers are incorporated in photographic emulsion layers. When the dye image formed is to be used in situ, couplers are selected which form non-diffusing dyes.

Soundtracks may be formed in color motion picture print film from the chromogenic sound recording films of the invention in accordance with conventional print film exposing and development processing. The resulting print film soundtracks may comprise dye images and/or silver images. Print film soundtracks comprising dye images may be formed in multiple photosensitive emulsion layers of the motion picture film, or may be restricted to a single emulsion layer as set forth in U.S. Pat. No. 2,176,303. However, as common sound systems for reading analog soundtracks incorporate a photodiode in the projector whose radiant sensitivity peaks at approximately 800–950 nm (depending on the type of photodiode), which detects the predominant infra-red (IR) radiation emitted by common tungsten lamps, in order to provide effective modulation of common projector soundtrack illumination light, motion picture print film is typically processed according to a system wherein the optical analog soundtrack area of the print film is developed differently from the picture image frame area so that a silver image is left in the soundtrack area of the film, whereas all the silver is removed in the picture frame area, leaving only a dye image. The silver image may be reformed selectively in the soundtrack area of the film through selective application of a second developer solution after initial uniform color development (which develops exposed silver halide in both the picture area and soundtrack area up to silver metal and generates image dye), stop bath and fixer (arrests development and removes undeveloped silver halide), and bleach (converts exposed, developed silver back to silver halide in both the picture area and soundtrack area) steps. The second development step typically comprises application of a thick, viscous solution of a conventional black-and-white developer with a cellulose compound such as nitrosyl in a stripe solely onto the soundtrack area of the film, causing the silver halide in the soundtrack area to be selectively developed back into silver metal, while not affecting the silver halide in the image area. A subsequent fixing step then removes the silver halide from the image area, while leaving a silver image corresponding to the soundtrack exposure. Processing of motion picture print film is described, e.g., for the Kodak ECP-2B Process, in Kodak Publication No. H-24, Manual For Processing Eastman Color Films, referenced above. Various other techniques are also known for retaining silver in the soundtrack area, e.g., as set forth in U.S. Pat. Nos. 2,220,178, 2,341,508, 2,763,550, 3,243,295, 3,705,799, 4,139,382.

Use of the sound recording films of the invention may be used to form either silver soundtracks or silverless dye soundtracks in a print film as described above for use in combination with appropriate decoding apparatus. For improved performance for print film dye-only soundtracks, it is preferable to record and develop the soundtrack in a single photosensitive layer of the print film, and recover the signal from the dye only soundtrack using a narrow band (e.g., 10–30 nm bandwidth) light source the wavelength of which is chosen so as to coincide with the peak absorbance wavelength of the soundtrack dye. Where the cyan layer of the print film is used to record the soundtrack, e.g., a narrow band red light source would be used for reading the developed soundtrack. A red light emitting diode may be conveniently used for reading cyan dye-only soundtracks, e.g., as has been recently proposed by Dolby Laboratories in an announcement at the Association of Cinema and Video Laboratories (ACVL) Jun. 1–3, 1995 convention at Lake Tahoe, Nev. The use of such relatively monochromatic light sources for the soundtrack reader in combination with a single layer dye soundtrack maximizes the relative optical density difference between the dyed areas and the undyed transparent areas of the soundtrack while maintaining high contrast. While a conventional tungsten light source may perform poorly with a dye only soundtrack due to the relatively low signal generated in the solar cell of the soundtrack reader resulting from the poor modulation of the tungsten light by the image dyes, the use of a narrow monochromatic light source eliminates the presence of unmodulated light outside the absorbance spectrum of the dye only soundtrack striking the solar cell, thereby improving the modulation signal generated by the solar cell. Chromogenic sound recording films in accordance with the invention may be advantageously uniquely designed so as to form dye images for modulating light selectively for exposing a sound track image in one or more selected imaging layers of a print film for forming a dye-only sound track in a print film.

EXAMPLE 1

A dye-forming coupler dispersion was prepared as follows:

1) An oil phase was prepared by combining the following materials and heating to 60° C. with stirring until dissolution occurred:

| | |
|---|---|
| Cyan Coupler A | 344.0 g |
| Magenta Coupler B | 344.0 g |
| Coupler Solvent C | 511.0 g |
| Auxiliary Solvent D | 1600.0 g |

2) After dissolution occurred, the hot oil phase was quickly added to a preheated (46° C.) aqueous phase mixture of the following materials with stirring:

| | |
|---|---|
| Gelatin | 650.0 g |
| Alkanol-XC Surfactant (Dupont) | 600.0 g |
| Water | 5951.0 g |
| Total | 10000.0 g |

3) The mixture was then passed through a high pressure homogenizer, collected, auxiliary solvent D was removed under reduced pressure, and distilled water was added to replace the removed auxiliary solvent. The mixture was stirred and then rapidly chilled until the dispersion was set.

A monodisperse silver bromoiodide (3.3 mole % AgI) cubic grain emulsion of 0.13 micron edge length was optimally chemically sensitized with a sulfur and gold sensitizing agent and then spectrally sensitized with red sensitizing dye SD-1 (0.896 mmole/Ag mole) (peak sensitivity 670 nm). This red sensitized emulsion is designated CE-1. A second monodisperse silver bromoiodide (3.3 mole % AgI) cubic grain emulsion of 0.11 micron edge length was also prepared in a similar manner, but spectrally sensitized with green sensitizing dyes SD-2 (1.255 mmole/Ag mole) (peak sensitivity 550 nm) and SD-3 (0.081 mmole/Ag mole) (peak sensitivity 580 nm). This green sensitized emulsion is designated ME-1.

The 2-coupler dispersion was then mixed with additional gelatin, water, and silver halide and coated on a gelatin subbed acetate film support with Rem Jet backing in a single emulsion layer format with the following structure:

| Coating 1 | |
|---|---|
| Protective Overcoat Layer: | |
| Poly(dimethyl methacrylate) beads, | 9.0 mg/m$^2$ |
| Gelatin, | 1001 mg/m$^2$ |
| Spreading aids | |
| Gel hardener | |
| Emulsion Layer: | |
| Silver halide emulsion CE-1, | 1140 mg/m$^2$ |
| Gelatin, | 4272 mg/m$^2$ |
| Cyan Coupler A, | 1292 mg/m$^2$ |
| Magenta Coupler B, | 1292 mg/m$^2$ |

Support

Transparent gelatin subbed acetate film support with Rem Jet Backing. Rem jet is a black-pigmented, nongelatin layer on the back of the film base which provides antihalation and antistatic properties.

Coating 1 contained the red spectrally sensitized emulsion CE-1. Five additional coating were prepared. Coating 2 was similar to Coating 1, except soluble red absorbing dyes E and F were coated in the Overcoat Layer at levels of 73.4 mg/M$^2$ and 17.3 mg/M$^2$, respectively. Coating 3 was similar to Coating 2 except that the levels of red filter dye E and red filter dye F were changed to 101.6 mg/m$^2$ and 24.0 mg/M$^2$, respectively. Coating 4 was similar to Coating 1 except that a 1:1 mixture of red spectrally sensitized emulsion CE-1 and green spectrally sensitized emulsion ME-1 was used in place of CE-1. Coating 5 was similar to Coating 4, except soluble red absorbing dyes E and F and soluble green absorbing dye G were coated in the Overcoat Layer at levels of 73.4 mg/M$^2$, 17.3 mg/M$^2$, and 33.8 mg/m$^2$, respectively. Coating 6 was similar to Coating 5 except that the levels of red filter dye E, red filter dye F, and green filter dye G were changed to 101.6 mg/m$^2$, 24.0 mg/m$^2$, and 46.8 mg/M$^2$, respectively. Table I summarizes the differences among Coating 1–6.

TABLE I

| Coating | Emulsion (mg/m$^2$) | Filter Dyes (mg/m$^2$) |
|---|---|---|
| 1 | CE-1 (1140) | — |
| 2 | CE-1 (1140) | E (73.4) |
| | | F (17.3) |
| 3 | CE-1 (1140) | E (101.6) |
| | | F (24.0) |
| 4 | CE-1 (570) | — |
| | ME-1 (570) | |
| 5 | CE-1 (570) | E (73.4) |
| | ME-1 (570) | F (17.3) |
| | | G (33.8) |
| 6 | CE-1 (570) | E (101.6) |
| | ME-1 (570) | F (24.0) |
| | | G (46.8) |

A

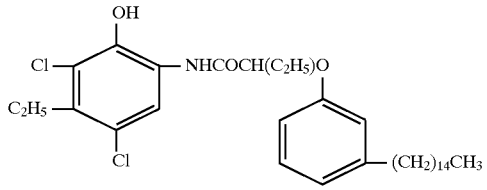

B

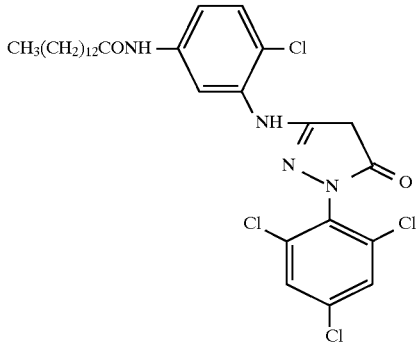

C

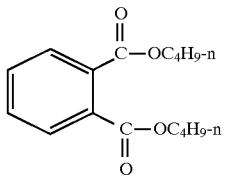

D

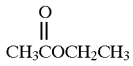

E

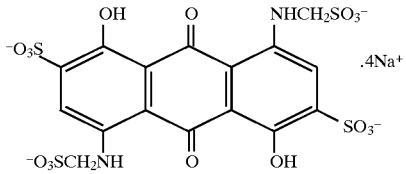

-continued

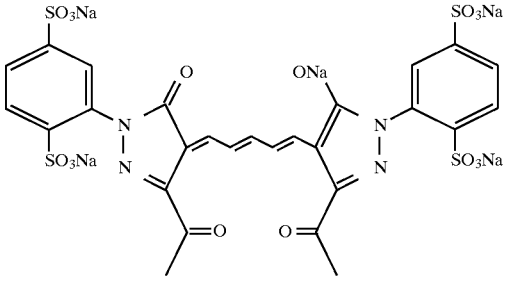

F

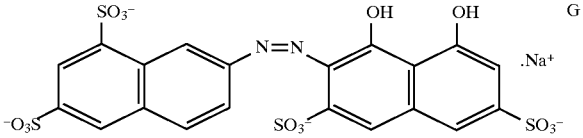

G

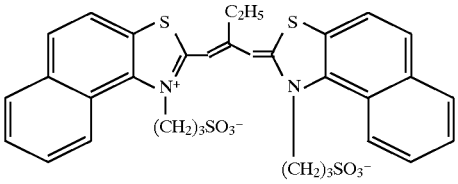

SD-1

$HN^+(C_2H_5)_3$

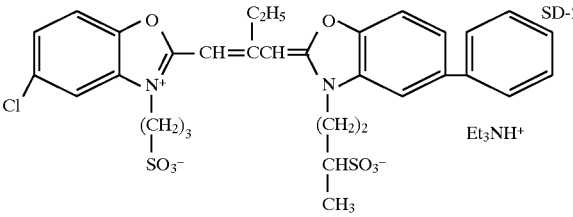

SD-2

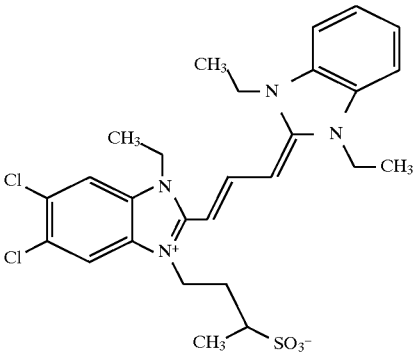

SD-3

The coated films were exposed to evaluate the sensitometric characteristics. Exposures (1000 μsec) were made with tungsten white light (color temp 2850° K.) through a heat absorbing filter and a 21 step tablet having a density range of 0–3.0 and 0.15 step increments, with the Ref Log E at the mid (11th) step of the tablet.

Each exposure was then processed in the standard ECN-2 development process as specified in Module 7 of the Kodak Publication H-24 titled "Manual for Processing Eastman Motion Picture Film". The standard process comprises Prebath (10 sec), Rem-Jet Removal and Rinse, Developer (3 min), Stop (30 sec), Wash (30 sec), UL Bleach (3 min), Wash (1 min), Fixer (2 min), Wash (2 min), Final Rinse (10 sec) and Dryer steps.

The resulting sensitometric parameters are provided in Table II, where Dmin and Dmax are the minimum and maximum Status M Red densities of the films after development, Speed is defined as 100(1-logE) at a Status M Red density of 2.5, and OG (overall gradient) is defined as the slope of the straight line portion of the Status M Red D logE characteristic curve between 0.3 and 2.3 above Dmin.

TABLE II

| | Sensitometric Parameters | | | |
|---|---|---|---|---|
| Coating No. | Dmin | Speed | OG | Dmax |
| 1 | 0.13 | 116 | 3.92 | 4.72 |
| 2 | 0.12 | 46 | 3.64 | 4.65 |
| 3 | 0.13 | 31 | 3.57 | 4.65 |
| 4 | 0.17 | 118 | 3.85 | 4.85 |
| 5 | 0.17 | 61 | 3.57 | 4.80 |
| 6 | 0.17 | 47 | 3.45 | 4.75 |

Samples from Coating 1–6 were also exposed on an RCA Optical Sound Recorder (tungsten lamp) and processed in the ECN-2 processing system to form analog sound track chromogenic negatives. The lamp current of the recorder was adjusted between 5.0–7.5 amps for the various samples to compensate for reduction in speed caused by the added absorber dyes to provide comparable red and green density values (approx. 2.3 and 3.4, respectively) for the resulting sound track negatives. The negatives were then printed on Eastman Kodak Co. ECP 5386 color print film with tungsten halogen light through Wratten 12 and Wratten 2B filters (yellow filter and UV filter). The exposed print films were then processed with ECP-2B processing to form positive print sound tracks with retained silver. Frequency Response and Signal-to-Noise ratio values (dB) for the print sound tracks obtained by printing the various chromogenic sound negatives were evaluated, and the results are shown in Table III below.

TABLE III

| Negative Sample Coating No. | Optical Recorder Lamp Current | Visual Print Density | Frequency Response (at 8K Hz) | Signal-to-Noise Ratio |
|---|---|---|---|---|
| 1 | 5 | 1.63 | −8.3 | 46.6 |
| 2 | 7 | 1.63 | −7.1 | 54.7 |
| 3 | 7.4 | 1.63 | −6.4 | 52.5 |
| 4 | 5.2 | 1.65 | −7.9 | 52.6 |
| 5 | 6.8 | 1.63 | −6.9 | 54.7 |
| 6 | 7.2 | 1.63 | −6.4 | 54.9 |

The Frequency Response is a measurement of the change in amplitude of higher frequency sound signals reproduced on film relative to low frequency signals (where there is essentially no frequency response difference). Less negative Frequency Response values represent less of a change in amplitude in the reproduced signal and hence better reproduction. The Signal-to-Noise ratio is the measurement of how well the useful signal is separated from the noise of the film system (for normal sounds measured at 1000 Hz), and it is better with a higher ratio (i.e., representing relatively higher signal response and less noise). A printed sound track made on ECP 5386 from a black-and-white recorded negative made on commercially available Eastman Sound Recording Film 5373 when printed at comparable densities resulted in a Frequency Response of −6.5 dB at 8K Hz and a Signal-to-Noise ratio of 54.8. The data of Table III demonstrates that chromogenic sound recording films in accordance with the invention may be used to form negative sound tracks for printing positive sound tracks on print films with good print film densities. The data further illustrates that use of chromogenic sound recording films comprising absorber dyes in accordance with preferred embodiments of the invention result in print sound tracks with significantly improved sound quality as demonstrated by the Frequency response and Signal-to-Noise values, which values are comparable to those obtained with the prior art black-and-white sound recording film.

This invention has been described in detail with particular reference to preferred embodiments thereof. It will be understood that variations and modifications can be made within the spirit and scope of the invention.

We claim:

1. A chromogenic motion picture sound recording photographic film element for forming non-neutral images comprising a film support bearing at least one silver halide emulsion layer comprising at least one dye-forming coupler which forms a dye which absorbs primarily in the green or red region of the electromagnetic spectrum upon processing with color negative developer, wherein the element does not comprise a neutral-balanced combination of cyan, magenta, and yellow dye-forming couplers.

2. A sound recording film according to claim 1, wherein said silver halide emulsion layer is spectrally sensitized both above and below 600 nm.

3. A sound recording film according to claim 1, wherein said silver halide emulsion layer is spectrally sensitized with a green spectral sensitizing dye and a red spectral sensitizing dye.

4. A sound recording film according to claim 3, wherein said silver halide emulsion layer further comprises red and green absorber dyes.

5. A sound recording film according to claim 1, wherein said silver halide emulsion layer further comprises absorber dye which absorbs in the sensitivity range of the silver halide emulsion layer.

6. A sound recording film according to claim 1, wherein said emulsion layer comprises a silver halide emulsion comprising silver halide grains having an average grain size of less than 0.20 microns.

7. A sound recording film according to claim 1, wherein said emulsion layer comprises a silver halide emulsion comprising silver halide grains having an average grain size of less than 0.15 microns.

8. A sound recording film according to claim 1, wherein said film exhibits a maximum Status M Red or Green density of at least 3.4 after exposure with white light, 580 nm light, or 670 nm light and standard ECN-2 processing.

9. A sound recording film according to claim 1, wherein the emulsion layer comprises at least one of magenta dye-forming couplers or cyan dye-forming couplers.

10. A sound recording film according to claim 9, wherein the emulsion layer comprises both a magenta dye-forming coupler and a cyan dye-forming coupler.

11. A sound recording film according to claim 10, wherein the sound recording film is substantially free of yellow dye-forming couplers.

12. A sound recording film according to claim 1, wherein the sound recording film is substantially free of yellow dye-forming couplers.

13. A sound recording film according to claim 1, wherein the silver halide emulsion layer comprises a green or red spectrally sensitized silver halide emulsion comprising silver halide grains having an average grain size of less than 0.20 microns, a magenta dye-forming coupler and a cyan dye-forming coupler, and is substantially free of yellow dye-forming couplers.

14. A sound recording film according to claim 13, wherein said silver halide emulsion layer further comprises absorber dyes which absorb in the sensitivity range of the silver halide emulsion layer.

15. A sound recording film according to claim 13, wherein the silver halide emulsion layer comprises green and red spectrally sensitized silver halide emulsions comprising silver halide grains having an average grain size of less than 0.20 microns, and green and red absorber dyes.

16. A method for forming a soundtrack image in a motion picture print film, comprising (a) recording a soundtrack negative in a chromogenic sound recording film according to claim I by exposing said sound recording film and processing said exposed film with a color developer process to form a non-neutral dye soundtrack negative, and (b) printing a soundtrack onto a negative-working motion picture print film by exposing the motion picture print film through the dye soundtrack negative and processing the exposed print film to form a positive soundtrack.

17. A method according to claim 16, wherein the sound recording film emulsion layer comprises at least one of magenta dye-forming couplers or cyan dye-forming couplers, and the sound negative film is exposed and processed to form a dye soundtrack comprising magenta or cyan dye.

18. A method according to claim 16, wherein the sound recording film emulsion layer comprises both a magenta dye-forming coupler and a cyan dye-forming coupler and is substantially free of yellow dye-forming couplers, and the sound negative film is exposed and processed to form a dye soundtrack comprising magenta and cyan dye.

19. A method according to claim 16, wherein the silver halide emulsion layer of the sound recording film comprises a green or red spectrally sensitized silver halide emulsion comprising silver halide grains having an average grain size of less than 0.20 microns, a magenta dye-forming coupler and a cyan dye-forming coupler, is substantially free of yellow dye-forming couplers, and the sound negative film is exposed and processed to form a dye soundtrack comprising magenta and cyan dye.

20. A method according to claim 19, wherein the silver halide emulsion layer of the sound recording film comprises green and red spectrally sensitized silver halide emulsions comprising silver halide grains having an average grain size of less than 0.20 microns.

* * * * *